US007325407B2

(12) United States Patent
Chen

(10) Patent No.: US 7,325,407 B2
(45) Date of Patent: Feb. 5, 2008

(54) THERMOELECTRIC AIR CONDITIONER

(76) Inventor: Chuan-Sheng Chen, Fl. 12, No. 137, Sec. 4, JenAi Road, Taipei (TW)

( * ) Notice: Subject to any disclaimer, the term of this patent is extended or adjusted under 35 U.S.C. 154(b) by 348 days.

(21) Appl. No.: 11/100,505

(22) Filed: Apr. 7, 2005

(65) Prior Publication Data

US 2006/0075756 A1 Apr. 13, 2006

(30) Foreign Application Priority Data

Oct. 7, 2004 (TW) ..... 93215918 U

(51) Int. Cl.
*F25B 21/02* (2006.01)

(52) U.S. Cl. ..... 62/3.3; 62/3.2

(58) Field of Classification Search ..... 62/3.2, 62/3.3, 3.6, 3.7, 259.2
See application file for complete search history.

(56) References Cited

U.S. PATENT DOCUMENTS 5,431,021 A * 7/1995 Gwilliam et al. ..... 62/3.7
5,761,908 A * 6/1998 Oas et al. ..... 62/3.2
6,006,524 A * 12/1999 Park ..... 62/3.7
6,158,224 A * 12/2000 Hu et al. ..... 62/3.4

* cited by examiner

*Primary Examiner*—Melvin Jones
(74) *Attorney, Agent, or Firm*—Leong C. Lei

(57) ABSTRACT

A thermoelectric air conditioner includes semiconductor, cold and hot ducts, fins, temperature controller and fan installed in a casing; cold air or hot air generated through the process by the thermoelectric cooling chip before being delivered through superconductor ducts free of barrier to be stored by fins; and push buttons provided on the user interface of the temperature controller allowing the air temperature to be controlled at constant, cooler or hotter before delivering the air stored in fins through the fan for the room to arrive at the temperature desired in short time.

2 Claims, 1 Drawing Sheet

THERMOELECTRIC AIR CONDITIONER

BACKGROUND OF THE INVENTION (a) Technical Field of the Invention

The present invention is related to a thermoelectric air conditioner, and more particularly to one operating on a ceramic thermoelectric cooling chip incorporated with hot/cold thermoelectric ducts without depending on coolant, air compressor or heater to arrive at and maintain the room temperature as desired.

(b) Description of the Prior Art

Many new products have been introduced thanks to the rapid development in technology to make our daily life easier, but not necessarily healthier. As a result, reports of diseases because of modernization including cancer are increasing every year, our environment is seriously polluted, and a hole has developed in the ozone layer to admit more radiations which endanger our health. Modem technology becomes another type of intangible killer to the human being. Excessive consumption of energy by hi-tech industry results in oil shortage, higher costs from energy use, and one of the primary causes of panic in relation to the energy crisis. The conventional air conditioner for example operates on coolant and air compressor to achieve the room temperature as desired. Coolant has been blamed for the destruction of the ozone layer and the greenhouse effects in which all scientists around the world have been warning us about the consequences. The conventional air conditioner for producing noise and consuming too much energy has significantly affected the quality of our environment and energy supply. Furthermore, it is heavy and large to prevent easy handling and installation. Therefore, we need an air conditioner that is compact in construction, power saving, allows easy handling and installation, and more importantly, not detrimental to our environment.

SUMMARY OF THE INVENTION

The primary purpose of the present invention is to provide an innovative and revolutionary construction of a thermoelectric air conditioner to eliminate those defectives including damage to nature, human health risk, high power consumption, big and heavy, and wasted labor for installation as found with the conventional air conditioner operating on coolant and air compressor. The present invention is free of any public nuisance to the environment by achieving the room temperature as desired within a short time, compact construction without coolant and air compressor, allowing easy installation and operation, and providing significant savings in power consumption. To achieve the purpose, the present invention is comprised of a casing, ceramic thermoelectric cooling chip, superconductor duct, fins, temperature controller and fan. Cold or hot energy is generated through the process by the thermoelectric cooling chip and then transferred through the duct without barrier to be stored in fins before being delivered through the fan and an air outlet provided on a panel on the casing. Push buttons adapt to the user interface of the temperature controller to control the room temperature as desired.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
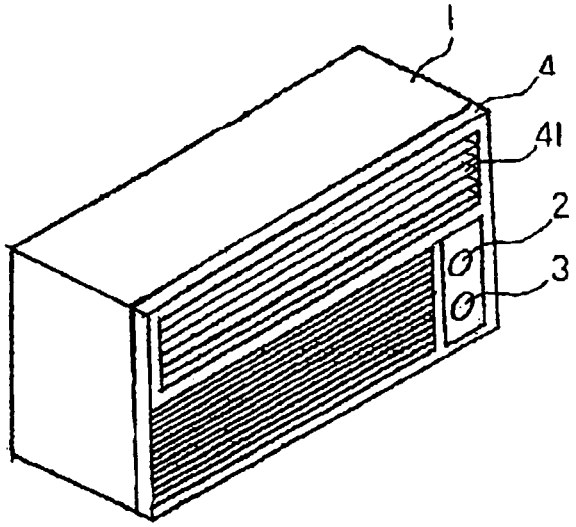
FIG. 1 is a schematic view showing the appearance of a preferred embodiment of the present invention.

Referring to FIG. 1, the present invention is comprised of a casing 1 and multiple essential members inside the casing. The casing (1) includes a power switch 2, a temperature controller 3, a panel 4, and an air outlet 41 on the panel 4.

Figure 2:
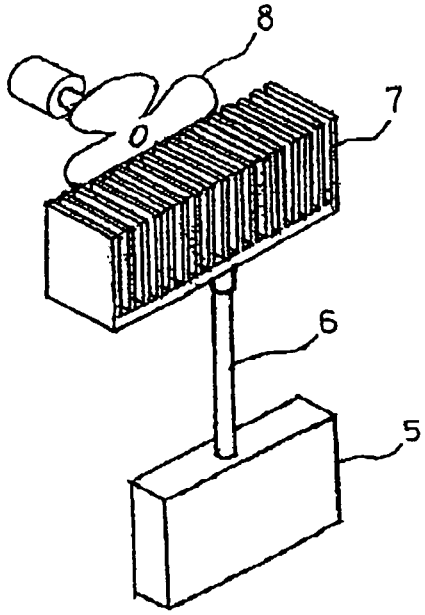
FIG. 2 is a schematic view showing the mechanism of the preferred embodiment in a casing of air conditioner.

As illustrated in FIG. 2, those essential members include a thermoelectric cooling chip 5, a superconductor duct 6, multiple fins 7, and a fan 8. In the preferred embodiment of the present invention, the thermoelectric cooling chip 5 relates to a ceramic chip. Cold or hot energy is generated through the process by the thermoelectric cooling chip 5 and then transferred without barrier through the superconductor duct 6 to be stored in those fins 7. Push buttons adapted to the user interface of the temperature controller 3 are used to control whether the temperature will be maintained at constant, higher or lower as desired before the cold or hot energy stored in those fins 7 is delivered through the fan 8 and the air outlet 41 to achieve in a short time the room temperature as desired.

Coolant and air compressor as found with a conventional air conditioner are not required in the present invention to achieve the same purpose with a range of temperature from −5° C. up to 85° C. adjustable by the user. The present invention allows easy operation, causes no danger to the ozone layer of the earth, presents no public nuisance to the environment, and a significant saving of 80%~90% power consumption when compared to the prior art installed with coolant and air compressor.

Figure 3:
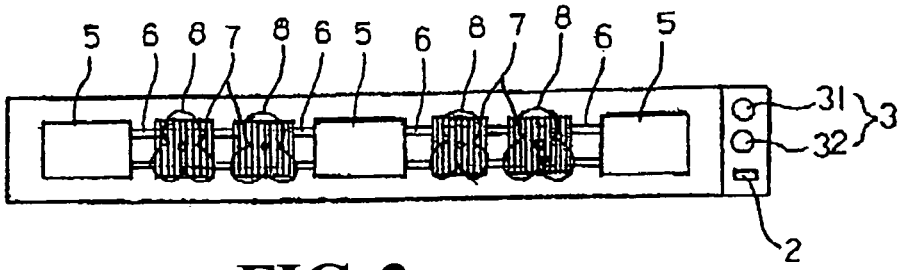
FIG. 3 is a layout of the preferred embodiment of the present invention.

Now referring to FIG. 3, those essential members of the present invention are made in module containing the thermoelectric cooling chip 6, the superconductor duct 6, those multiple fins 7, the fan 8 and the temperature controller 3. Multiple modules are connected and the temperature controller 3 is divided into two parts, a cold air controller 31 and a hot air controller 32 to respectively control the temperature of cool and hot air.

The present invention is innovative. It provides a significant solution in avoiding energy crisis, and is compact due to the absence of the thick and heavy air compressor, coolant piping and accessories. Furthermore, the casing 1 of the present invention may be omitted and all the essential members are separately mounted to compromise the interior decoration to provide an invisible air conditioner for appearance and practical purposes. Therefore, this application for a utility patent is duly filed accordingly.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A thermoelectric air conditioner includes a casing and basic members including a thermoelectric cooling chip, hot/cold conduits, fins, temperature controller and fan; cold or hot air being generated from the process by the thermoelectric cooling chip, air being delivered trough ducts without barrier, air being stored by fins, air temperature being adjusted to or maintained at constant through push buttons disposed on a user interface of the temperature controller; hot air or cold air stored in the fins being delivered through the fan to reach room temperature as desired in short time, the casing of the air conditioner is omitted and all members are separately installed at where appropriately, exposed or concealed to compromise the interior decoration while providing the same air conditioning purpose.

2. The thermoelectric air conditioner of claim 1, wherein the temperature controller is divided into a cold temperature controller and a hot temperature controller to respectively control the cold and hot air temperature as desired.

* * * * *